US010486123B2

(12) United States Patent
Kaufmann

(10) Patent No.: US 10,486,123 B2
(45) Date of Patent: Nov. 26, 2019

(54) DISPERSING DEVICE

(71) Applicant: IKA-Werke GmbH & CO. KG, Staufen (DE)

(72) Inventor: Axel Kaufmann, Neuenburg (DE)

(73) Assignee: IKA-Werke GmbH & CO. KG, Staufen (DE)

( * ) Notice: Subject to any disclaimer, the term of this patent is extended or adjusted under 35 U.S.C. 154(b) by 39 days.

(21) Appl. No.: 15/738,913

(22) PCT Filed: Jun. 21, 2016

(86) PCT No.: PCT/EP2016/001056
§ 371 (c)(1),
(2) Date: Dec. 21, 2017

(87) PCT Pub. No.: WO2017/001051
PCT Pub. Date: Jan. 5, 2017

(65) Prior Publication Data

US 2018/0185798 A1 Jul. 5, 2018

(30) Foreign Application Priority Data

Jul. 1, 2015 (DE) ..... 10 2015 008 480

(51) Int. Cl.
*B01F 15/00* (2006.01)
*B01F 7/00* (2006.01)

(52) U.S. Cl.
CPC .... *B01F 15/00318* (2013.01); *B01F 7/00725* (2013.01); *B01F 15/00012* (2013.01); *B01F 15/00396* (2013.01)

(58) Field of Classification Search
CPC ..... B01F 15/00012; B01F 15/00318; B01F 15/00396; B01F 7/00725; B01F 7/1635
See application file for complete search history.

(56) References Cited

U.S. PATENT DOCUMENTS 3,787,185 A * 1/1974 Rohrbaugh ..... G01N 35/025 366/331
4,704,035 A * 11/1987 Kowalczyk ..... B01F 15/00207 366/142
4,962,495 A * 10/1990 Gibbons ..... G01K 1/024 340/870.29
5,589,649 A * 12/1996 Brinker ..... B01L 7/00 219/385

(Continued)

FOREIGN PATENT DOCUMENTS

EP 0589093 A1 3/1994
EP 1782719 A1 5/2007

(Continued)

OTHER PUBLICATIONS

International Search report for corresponding PCT Application No. PCT/EP2016/001056 dated Oct. 12, 2016.

*Primary Examiner* — Tony G Soohoo
(74) *Attorney, Agent, or Firm* — Budzyn IP Law, LLC

(57) ABSTRACT

To simplify the handling of a dispersing device (1) and for the unique identification of dispersing tools (5) that are connectable to a drive unit (3) of the dispersing device (1), it is provided that the dispersing tool (5) has a transponder (10) and the dispersing device has a transmitter-receiver unit (11) for reading out the transponder (10).

21 Claims, 6 Drawing Sheets

(56) References Cited

U.S. PATENT DOCUMENTS

Figure 1:
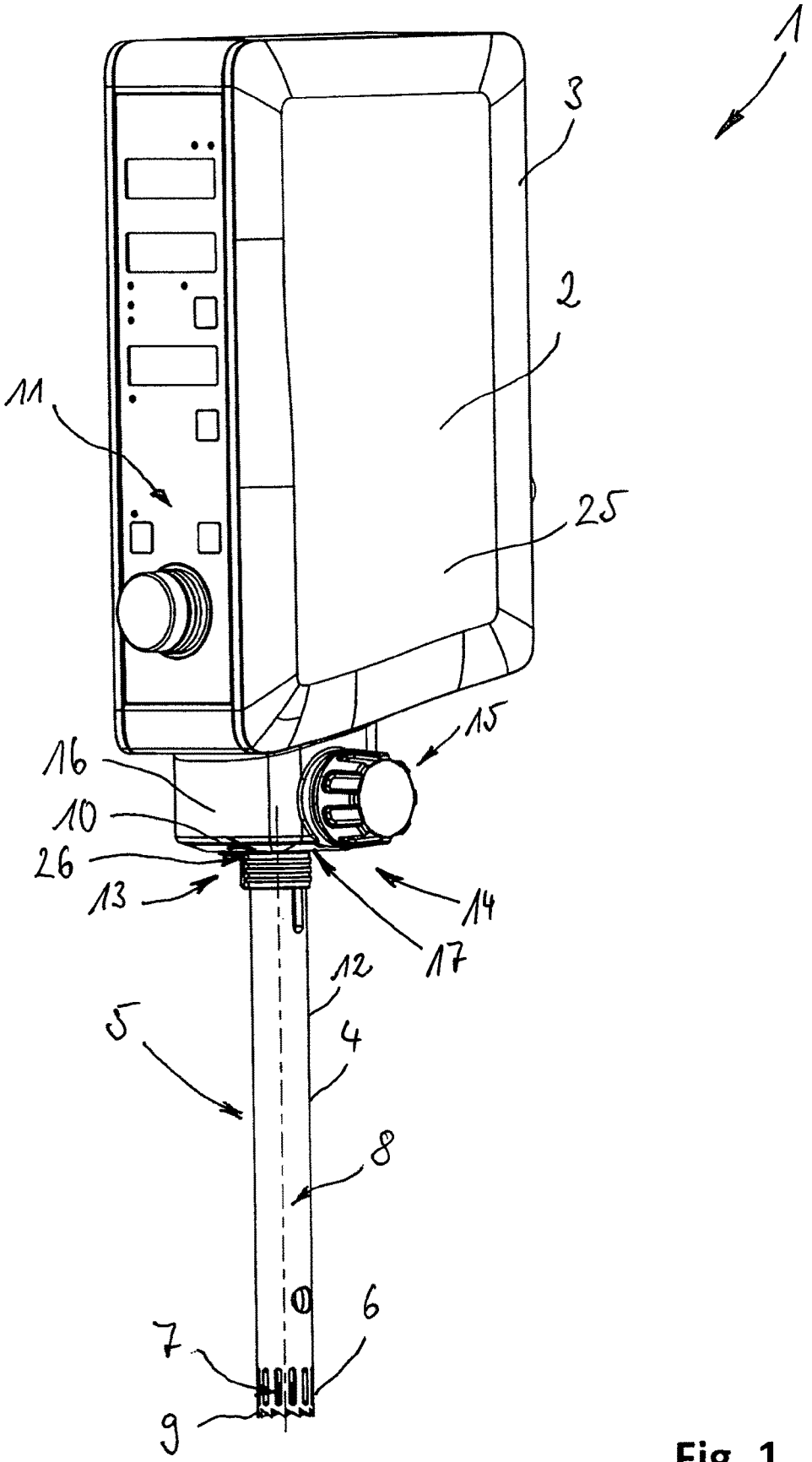

| | | | | |
|---|---|---|---|---|
| 8,903,673 | B2 * | 12/2014 | Brinker | G01N 13/00 220/23.87 |
| 9,731,254 | B2 * | 8/2017 | Gunia | B01F 3/0853 |
| 9,826,855 | B2 * | 11/2017 | Wu | A47J 36/32 |
| 10,238,234 | B2 * | 3/2019 | Lee | A47J 36/32 |
| 2010/0039883 | A1 * | 2/2010 | Foltyn | B01F 7/1605 366/142 |
| 2013/0101982 | A1 * | 4/2013 | Goodwin | B01F 7/00691 435/3 |
| 2015/0150403 | A1 * | 6/2015 | Wu | A47J 36/32 99/344 |
| 2016/0151751 | A1 * | 6/2016 | Eble | B01F 13/0818 366/146 |
| 2016/0290981 | A1 * | 10/2016 | Brinker | G01N 21/8507 |
| 2017/0089768 | A1 * | 3/2017 | Wu | A23L 5/13 |
| 2018/0160841 | A1 * | 6/2018 | Wu | H05B 3/80 |
| 2018/0185798 | A1 * | 7/2018 | Kaufmann | B01F 7/00725 |
| 2018/0311626 | A1 * | 11/2018 | Kaufmann | B01F 7/00033 |

FOREIGN PATENT DOCUMENTS

| | | | |
|---|---|---|---|
| EP | 2153887 | A2 | 2/2010 |
| WO | 2010052631 | A2 | 5/2010 |
| WO | 2012041412 | A1 | 4/2012 |
| WO | 2015063513 | A1 | 5/2015 |

* cited by examiner

DISPERSING DEVICE

The invention relates to a dispersing device having a drive unit which has a drive, and having a dispersing tool which has a shaft tube and at the free end of which, averted from the drive, there is provided a dispersing rotor which can be driven by means of a rotor shaft which is connectable or connected to the drive and which is arranged in the shaft tube.

Such dispersing devices with dispersing tools are already known in a wide variety of embodiments from the prior art. Here, it is common for different dispersing tools to be combined with one drive unit. The dispersing tools that can be combined with the drive unit are in this case each assigned particular operating parameters which should be adhered to in order to permit proper use of the dispersing tools and in order to achieve desired dispersing results.

In general, dispersing tools operated with such dispersing devices have for example an admissible service life or operating duration which should not be exceeded if it is sought to avoid damage to the dispersing tools.

Furthermore, dispersing tools exist which are approved for different rotational speeds and which therefore should not be operated at excessively high rotational speed.

In the use of such dispersing devices already known from the prior art, it has therefore hitherto generally be necessary to ensure that selected dispersing tools are not operated for an excessively long time and are not operated at a rotational speed which is not approved for the dispersing tools. This can make the handling of the dispersing device unduly difficult.

It is therefore an object of the invention to provide a dispersing device of the type mentioned in the introduction, the handling of which is simplified.

Said object is achieved in the case of the dispersing device defined in the introduction by the means and features of claim 1 and in particular in that the dispersing tool has a transponder and the dispersing device has a transmitter-receiver unit for reading out the transponder. In this way, it is possible for the dispersing tool that is coupled to the drive unit of the dispersing device to be automatically identified, and for the data linked to the coupled-on dispersing tool to be automatically incorporated in the use of the dispersing tool. This may be performed in particular by the drive unit by virtue of data and information stored in the transponder being automatically read out by the transmitter-receiver unit.

In this context, it may be expedient if the drive unit, in particular the transmitter-receiver unit of the drive unit, is configured for identification of the dispersing tool by means of data storable or stored on the transponder.

It may furthermore be expedient if the transponder is arranged on an outer side of the shaft tube. In addition or alternatively to this, it is possible for the transmitter-receiver unit to be formed in or on the drive unit. It is thus possible for each dispersing tool that can be connected or attached to the drive unit of the dispersing device according to the invention to be equipped with a transponder. On the transponder, there may be stored dispersing-tool-specific data which can then be automatically read out by the transmitter-receiver unit in or on the drive unit and evaluated by the drive unit. In particular if the transponder is arranged on an outer side of the shaft tube of the dispersing tool, a reliable transmission of data from the transponder to the transmitter-receiver unit and from the transmitter-receiver unit back to the transponder can be ensured, even if the shaft tube of the dispersing tool is produced from an electrically conductive and therefore potentially shielding material.

Here, the dispersing tool may have a coupling on its drive-side end facing toward the drive unit in a use position, and the drive unit may have a counterpart coupling, designed to fit with said coupling, for the transmission of torques from the drive to the rotor shaft.

Furthermore, the dispersing tool may, between the drive unit and the dispersing tool, have a tool coupling, in particular a bayonet-type tool coupling, by means of which the dispersing tool is detachably coupled to the drive unit and/or to the drive of the dispersing device. In this way, it is possible for the dispersing tool to be detachably connected to the drive of the dispersing device.

To permit an interference-free transmission of data from the transponder to the transmitter-receiver unit, it may be expedient if the transponder is arranged on a, for example the already abovementioned, or adjacent to a, for example the already abovementioned, drive-side end of the shaft tube. Here, it is possible for the transponder to be arranged on a, for example the already abovementioned, or adjacent to a, for example the already abovementioned, coupling of the dispersing tool or a or the tool coupling of the dispersing device. Thus, in the use position of the dispersing tool, the transponder can, with likelihood bordering on certainty, be arranged on the dispersing tool outside a medium for processing. In this way, it is possible to prevent the transponder from being shielded by medium for processing and a transmission of energy and data to the transponder from being disrupted.

The transponder can be even more reliably protected against possibly disruptive medium if, in the use position of the dispersing tool, said transponder is arranged within a dispersing tool receptacle of the drive unit.

In a particularly advantageous embodiment of the dispersing device according to the invention, it may also be provided, in addition or alternatively to that described above, that the transponder is writable, and that the transmitter-receiver unit is configured for writing to the transponder. In this way, it is possible, after use of the dispersing tool on the drive unit of the dispersing device, for data to be stored on the transponder of the dispersing tool by means of the transmitter-receiver unit.

It is for example conceivable that, after the admissible service life or operating duration of the dispersing tool is reached, an item of information in the form of a corresponding note, which prevents further use of the dispersing tool, is stored by means of the transmitter-receiver unit. It is thus possible that, in the event of the dispersing tool being used again, said dispersing tool is firstly identified by the transmitter-receiver unit of the drive unit, and then, owing to the stored note, an activation of the drive unit in combination with the prohibited dispersing tool is prevented.

The functional scope of the dispersing device can be expanded if at least one sensor is arranged on the dispersing tool. In a preferred embodiment of the dispersing device, said sensor may be arranged on the shaft tube on or adjacent to the free end of the shaft tube. As suitable sensors, use is made for example of temperature sensors, pH value sensors and/or pressure sensors and/or other sensors which are suitable for the monitoring of dispersing processes.

A, for example the already abovementioned at least one, sensor may, for the transmission of measurement data, be connectable or connected to the transponder of the dispersing tool by means of a sensor connection. Here, the sensor connection between the at least one sensor and the transponder may be formed by a wired connection. It is however pointed out that, in the context of the dispersing device according to the invention, the expression "sensor connection" is also to be understood to mean sensor connections which are realized wirelessly or else by means of an electrically conductive coating.

Thus, in the context of the present invention, the expression "sensor connection" is not restricted to a cable-based or cabled connection between the sensor and the transponder.

In interaction with at least one sensor, it may furthermore be expedient if the transponder has evaluation electronics for the processing of measurement data received from the at least one sensor and is designed for wirelessly transmitting measurement data to the drive unit. In particular, the measurement data may in this case be transmitted wirelessly to the transmitter-receiver unit of the drive unit of the dispersing device.

The cleaning of the dispersing tool can be made easier if a, for example the already abovementioned, sensor connection, the transponder and/or a, for example the already abovementioned, at least one sensor are of liquid-tight, preferably dishwasher-safe, form and/or are sealed. This thus means that the dispersing tool may be equipped with a sealingly, preferably hermetically, closed measurement system which permits the use of the dispersing tool even in harsh environments. Thus, there are no exposed contacts or cables which could sustain damage under the influence of harsh conditions and/or aggressive media.

In a particularly advantageous embodiment of the dispersing device, it may be provided that a, for example the already abovementioned, sensor connection is arranged in a groove formed into the shaft tube, in particular is welded or brazed in the groove. In this way, the sensor connection between the sensor and the transponder can be attached in a particularly well-connected manner to the shaft tube of the dispersing tool.

In addition or alternatively to this, it is also possible for a, for example the already abovementioned, sensor connection to comprise a sensor cable which runs in a sensor tube. Here, the sensor tube may preferably, in the use position, be arranged, for example welded or brazed, in a, for example the already abovementioned, groove in the shaft tube. In this way, the sensor cable that transmits the data signals can be arranged in a protected manner in the interior of the above-described sensor tube. The sensor tube in turn can be arranged in a recess manner in the groove in the shaft tube in order that it does not protrude in a disruptive manner.

If the shaft tube and the sensor connection which, in the use position, is arranged in the groove, and/or a, for example the abovementioned, sensor tube of the sensor connection, are ground such that the shaft tube has, along the sensor connection, an externally closed, in particular smooth and/or rounded, outer contour, it is possible to realize a dispersing tool with a shaft tube which is very easy to clean and which can be inserted for example through a rounded passage into a laboratory reactor vessel and sealed off in vacuum-tight fashion.

Although a protruding sensor tube or a sensor tube arranged deeper in a corresponding groove in the shaft tube would be easier to manufacture, such a sensor tube would however firstly be more difficult to clean and secondly would also be more difficult to insert through a rounded passage in a laboratory reactor vessel, and it would be more difficult for said rounded passage to then be sealed off in vacuum-tight fashion.

To be able to control and/or regulate the dispersing process in a manner dependent on data stored on the transponder and/or in a manner dependent on measurement values detected by a, for example the already abovementioned, at least one sensor, it is expedient if the dispersing device, in particular the drive unit, has a control and/or regulation unit which is connected, for exchange of data, to the drive and to the transmitter-receiver unit. By means of said control and/or regulation unit, the drive can be controllable and/or regulable in a manner dependent on data transmitted from the transmitter-receiver unit to the control and/or regulation unit. The transmitter-receiver unit in turn can receive the data from the transponder and/or from a, for example the already abovementioned, at least one sensor, which is connected to the transponder, on the shaft tube of the dispersing tool, and said transmitter-receiver unit can then transmit said data to the control and/or regulation unit.

It may be advantageous if the transponder is formed as an RFID chip. In addition or alternatively to this, it may be provided that the transponder has a data memory on which dispersing-tool-specific data, in particular operating data of the dispersing tool, and/or data received from a, for example the already abovementioned, at least one sensor of the dispersing tool, and/or data transmitted from the transmitter-receiver unit to the transponder, are storable and/or stored.

In this way, it is possible, during use or at least after use of the dispersing tool, for the usage duration or operating duration or the service life of the dispersing tool to be updated, and to thus be provided with information and indications as regards when an exchange and/or maintenance/repair of the dispersing tool should be performed, by means of the transmitter-receiver unit of the drive unit.

On the other hand, in this way, it is also possible for measurement values detected during the dispersing process, which measurement values generally relate to the medium for dispersal, to also be written and stored on the data memory of the transponder. The data stored on the data memory of the transponder may either be read out by means of the transmitter-receiver unit already during a dispersing process, or else may be transmitted to the transmitter-receiver unit, for further evaluation, after the end of a dispersing process.

In a further advantageous embodiment of the dispersing device according to the invention, it may furthermore be provided that the dispersing device has, and/or is connectable to or, in the use position, connected to, a temperature-control device for controlling a temperature of medium for dispersal.

Here, said temperature-control device may preferably be controllable or regulable, in particular by means of a, for example the already abovementioned, control-regulation unit of the dispersing device, in a manner dependent on data transmitted from a, for example the already abovementioned, at least one sensor and/or from the transponder.

In this way, it is possible, in accordance with the measurement values determined by means of the at least one sensor, for the medium for dispersal to be correspondingly heated and/or cooled during the dispersing process, should this be necessary on the basis of the determined measurement value. It is pointed out that said measurement value will generally be a temperature value. It is however also not ruled out for other measurement values and/or parameters of medium for dispersal to be determined by means of the at least one sensor, and for not only the drive of the drive unit but indeed also the temperature-control device of the dispersing device to be correspondingly regulated and/or controlled in a manner dependent on the determined measurement values of said parameters.

Figure 2:
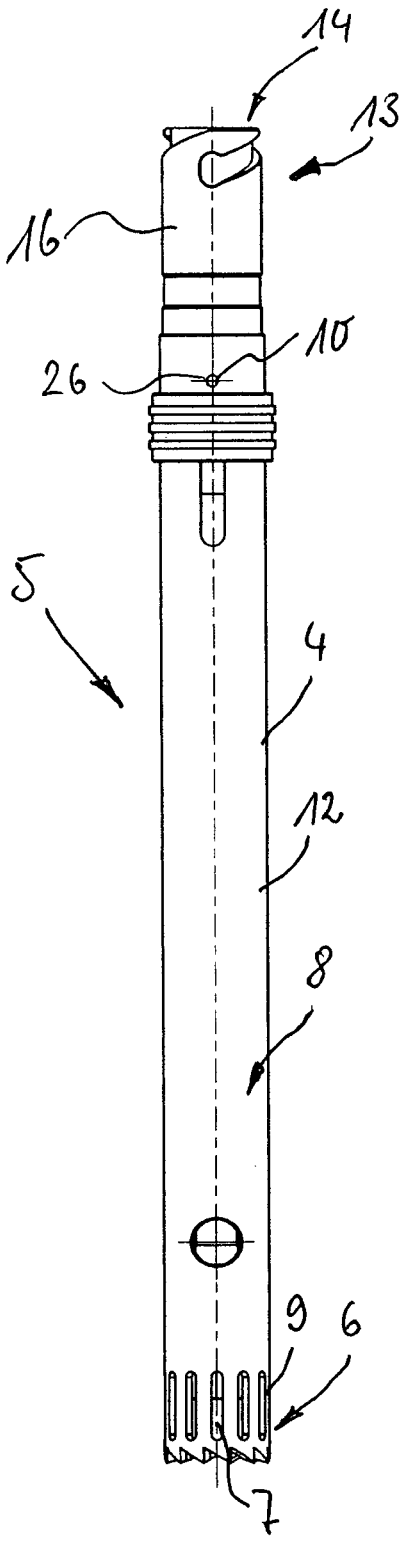
Figure 3:
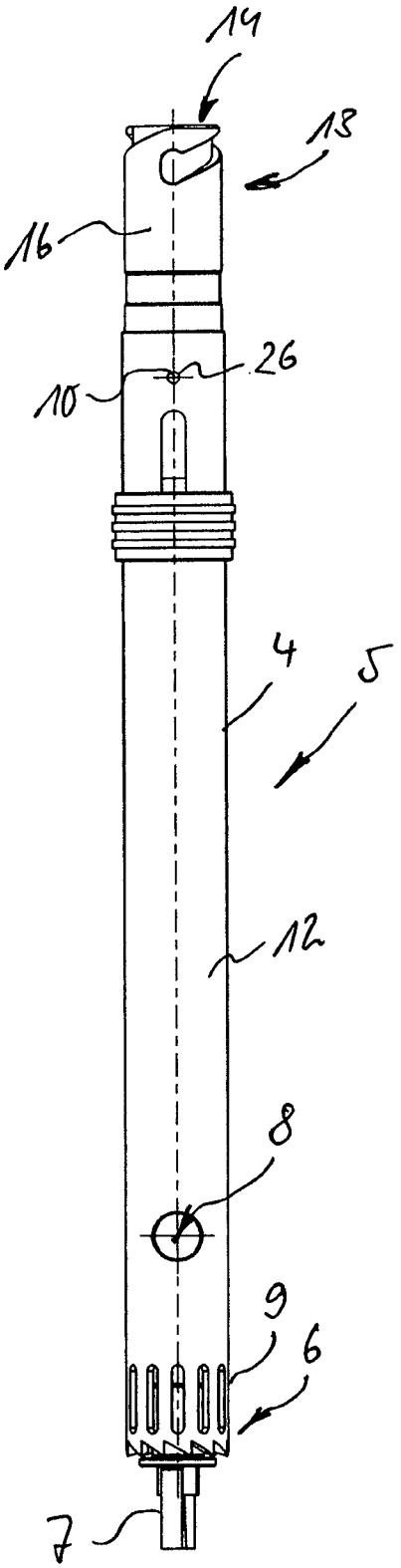
Figure 4:
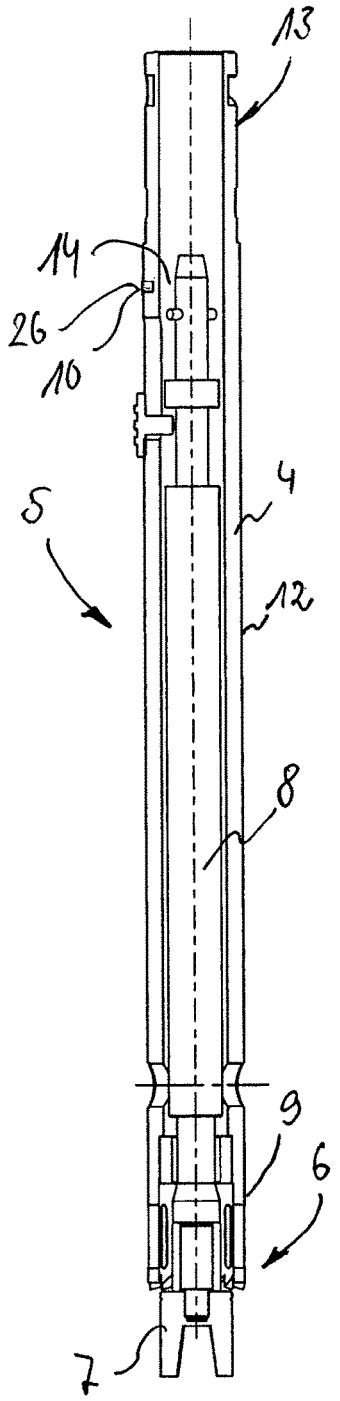
Figure 5:
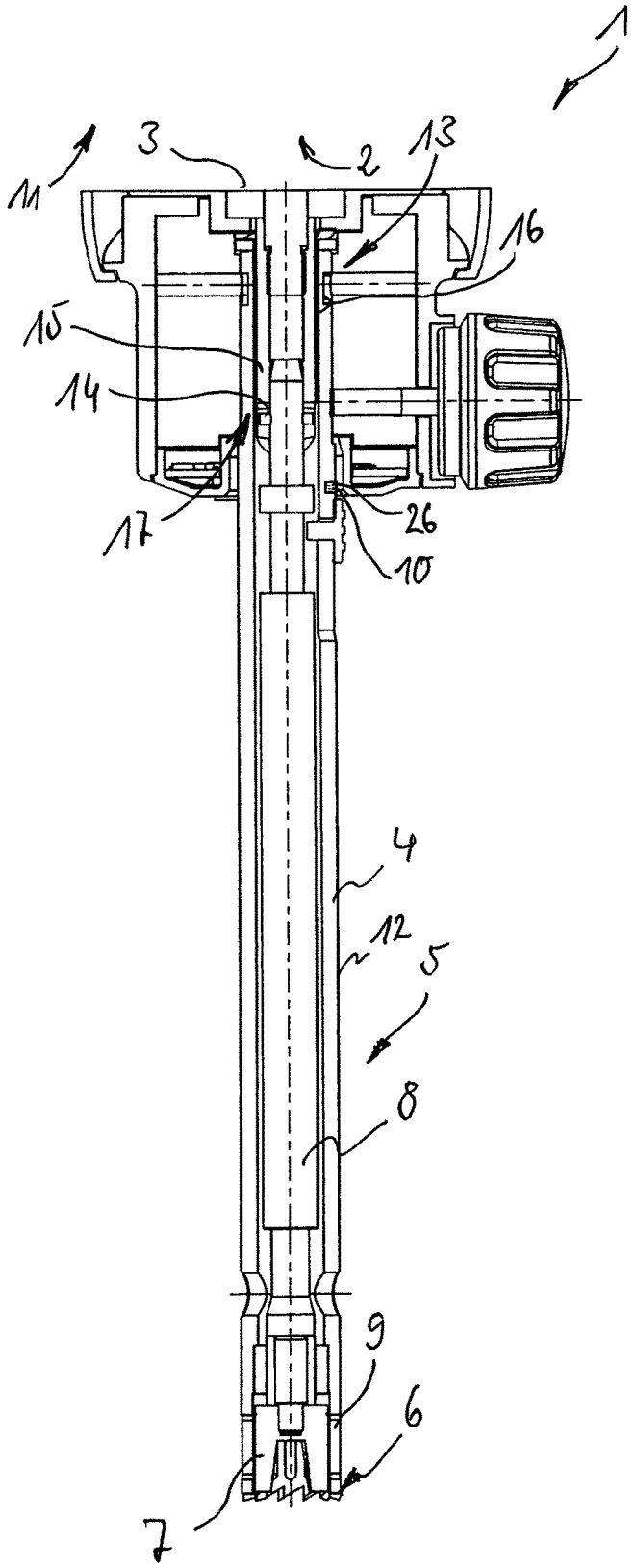
Figure 6:
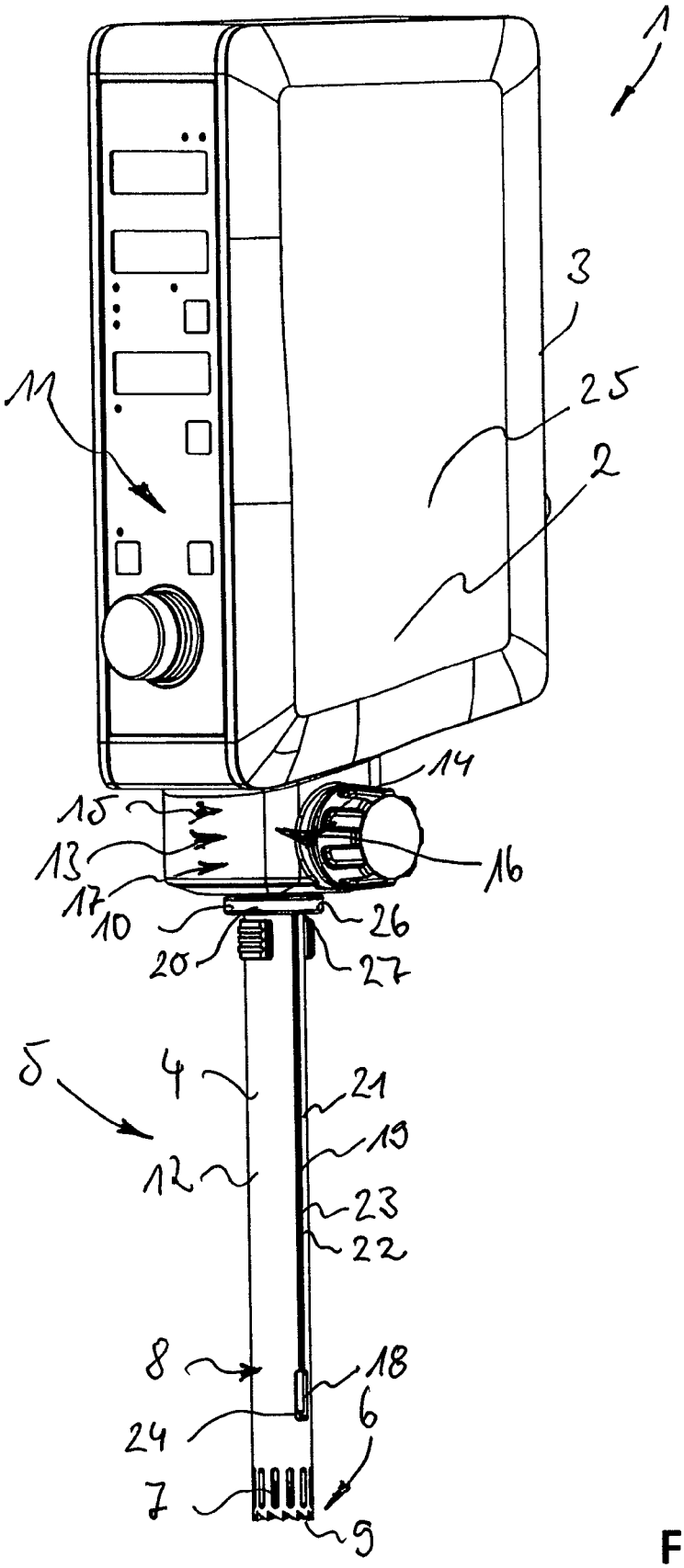
Figure 7:
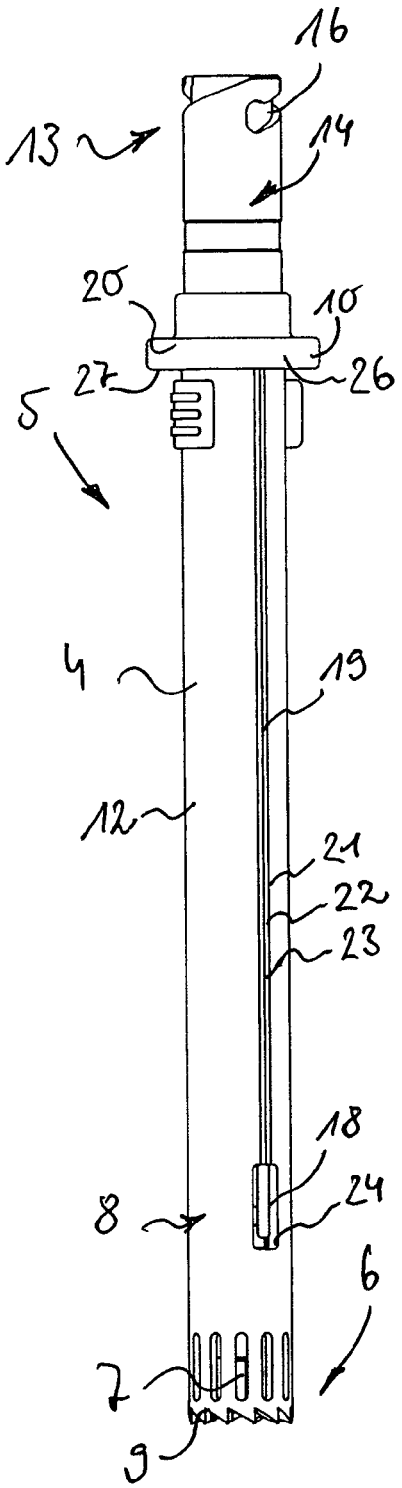
Figure 8:
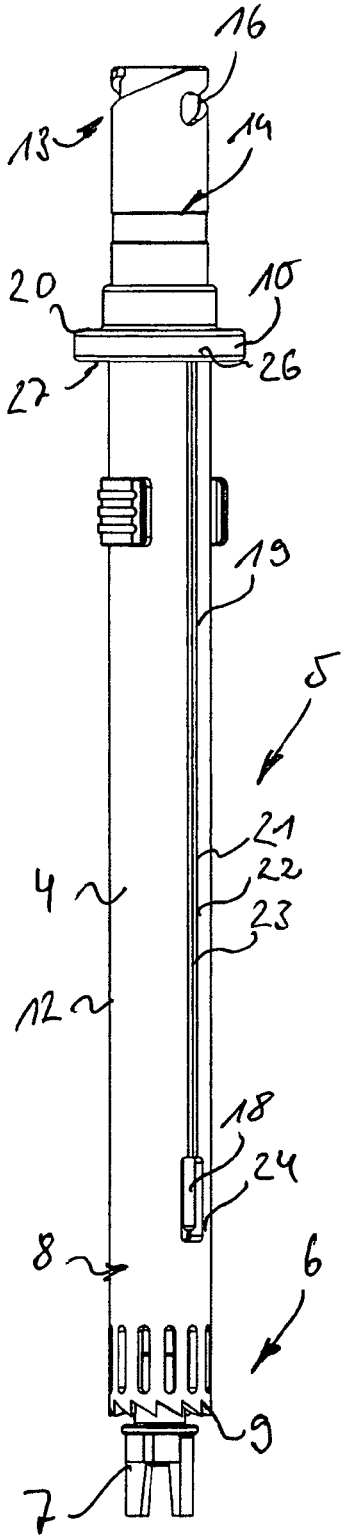
Figure 9:
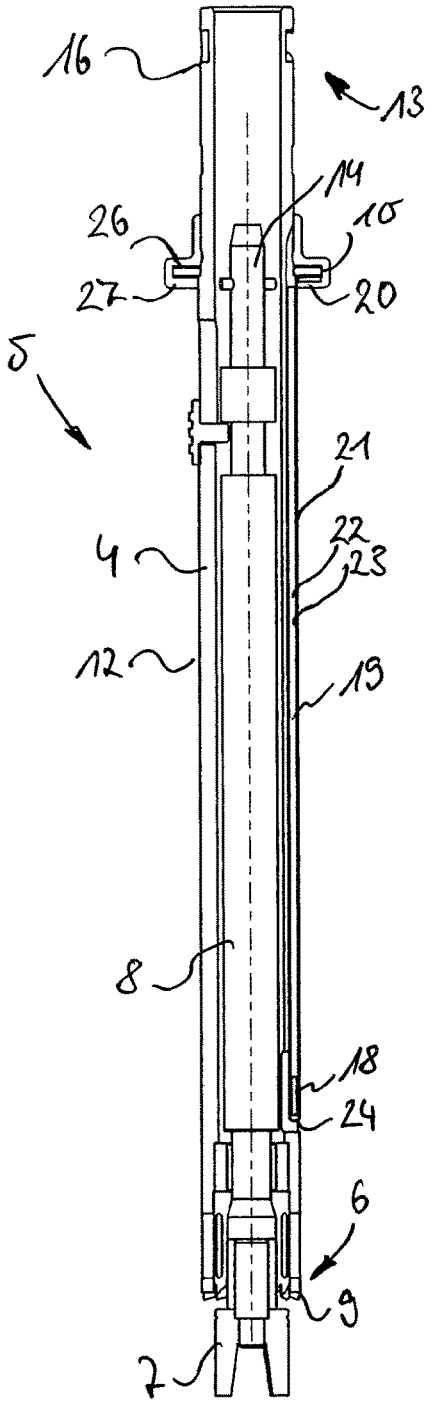
Figure 10:
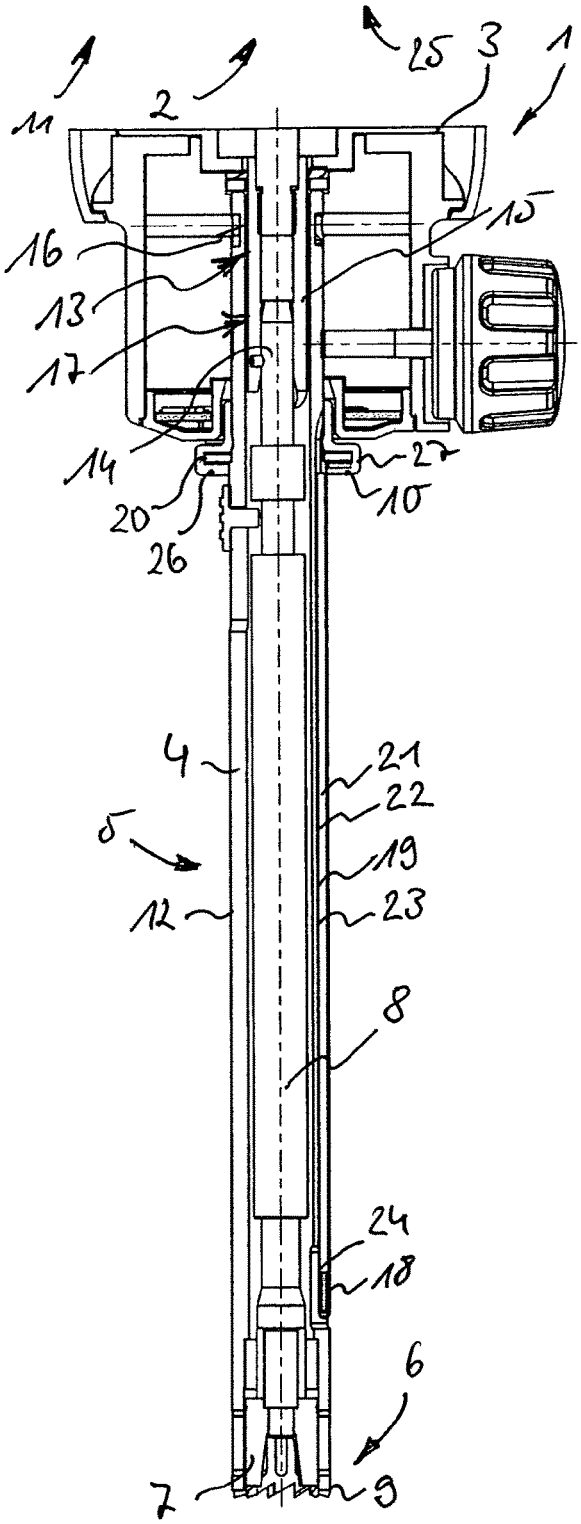

Below, two exemplary embodiments of the dispersing device according to the invention will be described in more detail on the basis of the drawing. In the drawing, in part in a schematic illustration:

FIG. 1 shows a perspective side view of a dispersing device according to the invention, wherein a drive unit of the dispersing device and a dispersing tool according to the invention connected to said drive unit can be seen, FIG. 2 shows a side view of the dispersing tool according to the invention illustrated in FIG. 1, with a tool coupling, formed as a bayonet-type tool coupling, at a drive-side end of the dispersing tool and with a stator at the free end, situated opposite the drive-side end, of the dispersing tool, wherein the dispersing tool is equipped, at its drive-side end, with a transponder formed as an RFID tag, FIG. 3 shows the dispersing tool according to the invention illustrated in FIGS. 1 and 2, wherein the dispersing rotor of the dispersing tool is illustrated in a cleaning position displaced forward out of the shaft tube of the dispersing tool, FIG. 4 shows a sectional side view of the dispersing tool according to the invention illustrated in FIGS. 1 to 3, FIG. 5 shows a sectional partial view of the dispersing device illustrated in FIG. 1, wherein a transponder on the shaft tube of the dispersing tool can be seen, FIG. 6 shows a perspective side view of the dispersing device illustrated in FIG. 1, with a further dispersing tool according to the invention, on the outer side of which there is arranged a temperature sensor, FIG. 7 shows a side view of the dispersing tool according to the invention illustrated in FIG. 6, wherein a dispersing rotor of the dispersing tool is illustrated in an arrangement in its working position in the interior of the shaft tube of the dispersing tool, and a temperature sensor which is arranged in an external depression of the shaft tube and which is connected by means of a sensor connection to the transponder of the dispersing tool can be seen, FIG. 8 shows the dispersing tool illustrated in FIGS. 6 and 7 with its dispersing rotor in a cleaning position displaced forward out of the shaft tube, FIG. 9 shows a sectional side view of the dispersing tool according to the invention illustrated in FIGS. 6 to 8 with its dispersing rotor situated in a cleaning position, and FIG. 10 shows a sectional side view of the dispersing device according to the invention illustrated in FIG. 6 with a dispersing tool which has a temperature sensor and on whose end facing toward the drive the transponder can be seen.

FIGS. 1 and 6 show a dispersing device denoted as a whole by 1, having a drive unit 3 which has a drive 2, and having a dispersing tool 5 which has a shaft tube 4. On a free end 6, averted from the drive 2, of the shaft tube 4 and thus also of the dispersing tool 5, there is provided a dispersing rotor 7 which can be driven by means of a rotor shaft 8 which is connectable, and in a use position is connected, to the drive 2 and which is arranged in the shaft tube 4.

On the free end 6, averted from the drive 2, of the shaft tube 4 there is formed a stator 9, relative to which, during the operation of the dispersing device 1, the dispersing rotor 7 rotates and thus thoroughly mixes the medium for dispersal, which is not illustrated in the figures.

The dispersing tool 5 has a transponder 10, and the dispersing device 1 has a transmitter-receiver unit 11 for reading out the transponder 10.

The drive unit 3 is, by means of its transmitter-receiver unit 11, configured for identifying the dispersing tool 5 with the aid of data stored or stored on the transponder 10.

All of the figures show that the transponder 10 is arranged on an outer side 12 of the shaft tube 4 of the dispersing tool 5. In the case of the dispersing device 1 illustrated in FIGS. 1 and 6, the transmitter-receiver unit 11 is formed within the drive unit 3.

The dispersing tool 5 has a coupling 14 on its drive-side end 13 facing toward the drive unit 3 in the use position, and the drive unit 3 has a counterpart coupling 15, designed to fit with said coupling, for the transmission of torques from the drive 2 to the rotor shaft 8. Furthermore, on the dispersing device 1, there is provided a tool coupling 16 which is formed as a bayonet-type tool coupling and by means of which the dispersing tool 5 can be fixedly connected to the drive unit 3 of the dispersing device 1. In this way, it is possible for the dispersing tool 5 to be detachably connected to the drive 2 of the drive unit 3 of the dispersing device 1.

All of the figures furthermore show that the transponder 10 is arranged adjacent to the drive-side end 13 of the shaft tube 4 and adjacent to the coupling 14 of the dispersing tool 5 and also adjacent to the tool coupling 16. This makes it possible for the transponder 10, in the use position of the dispersing tool 5, to be arranged on the dispersing tool 5 outside a medium for processing.

In particular, the exemplary embodiment of the dispersing device 1 according to the invention as per FIG. 5 shows here that the transponder 10 is arranged so closely adjacent to the tool coupling, formed as a bayonet-type tool coupling 16, of the dispersing tool 5 that said transponder is arranged within a dispersing tool receptacle 17 of the drive unit 3 of the dispersing device and is thus protected by the latter against the influence of the medium for dispersal. The transponders 10 illustrated in the figures are writable, and the transmitter-receiver unit 11 of the drive unit 3 is configured for writing to the transponder 11.

Adjacent to the free end 6 of the shaft tube 4, the dispersing tool 5 illustrated in FIGS. 6 to 10 has a sensor 18 which, in the present exemplary embodiment of the dispersing tool 5, is formed as a temperature sensor. In an exemplary embodiment of the dispersing device according to the invention which is not illustrated in the figures, said sensor 18 is formed as a pH value sensor and/or as a pressure sensor. The use of further sensors with other functionality is not ruled out. It is furthermore conceivable for a dispersing tool 5 to be equipped with multiple, preferably different sensors 18.

The sensor 18 is connected to the transponder 10, for transmission of measurement data, by means of a sensor connection 19 which, in the exemplary embodiment illustrated in the figures, is of line-based or cable-based form. The transponder 10 illustrated in FIGS. 6 to 10 furthermore has evaluation electronics 20 for processing measurement data received from the sensor 18. Furthermore, the transponder 10 with the evaluation electronics 20 is also configured for wirelessly transmitting measurement data to the transmitter-receiver unit 11 of the drive unit 3.

FIGS. 6 to 10 furthermore show that the sensor connection 19, the transponder 10 and the sensor 18 are of liquid-tight and dishwasher-safe form and are sealed.

The sensor connection 19 is arranged in a groove 21 formed into the shaft tube 4, and in the present case is welded or brazed in the groove 21. To be able to protect the cable-based sensor connection 19 against external influences, the sensor connection 19 has a sensor cable 23 which runs in a sensor tube 22, wherein the sensor tube 22 is, in the use position, arranged, in this case welded or brazed, in the groove 21 in the shaft tube 4. The shaft tube 4 and the sensor connection 19 which, in the use position, is arranged in the groove 21, that is to say in this case the sensor tube 22 with the sensor cable 23 of the sensor connection 19 running therein, are ground such that the sensor tube 4 has, along the sensor connection 19, an externally closed, smooth and rounded outer contour without projections or an offset.

While the sensor connection 19 is arranged on the dispersing tool 5 so as to be protected, by the sensor cable 23 running in the sensor tube 22, against possible damaging influences of the medium for dispersal, the sensor 18 of the dispersing tool 5 is arranged in an open depression 24 on the shaft tube 4. The sensor 18 of the dispersing tool 5 can thus come into contact with the medium for dispersal, in order to be able to reliably and as accurately as possible determine a corresponding parameter of the medium, generally the temperature thereof. It is pointed out that the sensor 18 is arranged in the depression 24 such that it does not protrude beyond the outer diameter of the shaft tube 4. It is thus possible to prevent the sensor 18 from posing an obstruction during cleaning of the dispersing tool 5 or during an insertion of the dispersing tool 5 into a passage, for example of a laboratory reactor vessel or the like.

The drive unit 3 of the dispersing device 1 has a control and/or regulation unit 25 which is connected to the drive 2 and to the transmitter-receiver unit 11. By means of the control and/or regulation unit 25, the drive 2 can be controllable and/or regulable, or controlled or regulated, in a manner dependent on data transmitted from the transmitter-receiver unit 11 to the control and/or regulation unit 25. For this purpose, use may be made inter alia of the measurement values of the sensor 18, which are transmitted to the transmitter-receiver unit 11.

It is however also conceivable for operating data of the dispersing tool 5, which are stored in the transponder 10 of the dispersing tool 5, to be transmitted to the transmitter-receiver unit 11 of the dispersing tool 5, and for the dispersing process to be performed by means of the control and/or regulation unit 25 in accordance with the read-out parameters and data.

The transponders 10 illustrated in the figures are formed as RFID chips, and have a data memory 26 on which dispersing-tool-specific data, in particular operating data of the dispersing tool 5, and data received from the sensor 18 of the dispersing tool 5 and data transmitted from the transmitter-receiver unit 11 to the transponder 10, are storable and/or stored.

The dispersing tool 5 illustrated in FIGS. 6 to 10 has an encircling collar 27 close to its drive-side end 13. The transponder 10 with the evaluation electronics 20 is arranged in a well-protected manner in said collar 27. In the use position of the dispersing tool 5, the collar 27 closes off the dispersing tool receptacle 17 and limits the depth to which the dispersing tool 5 is inserted into the dispersing tool receptacle.

In an exemplary embodiment of the dispersing device 1 according to the invention which is not illustrated in the figures, said dispersing device has a temperature-control device for controlling the temperature of medium for dispersal, or is connected to such a temperature-control device in the use position. Here, said temperature-control device may preferably be controlled or regulated, in particular by means of the control and/or regulation unit 25 of the dispersing device 1, in a manner dependent on data transmitted from the sensor 18 and from the transponder 10.

To make the dispersing device 1 easier to handle, and for unique identification of dispersing tools 5 that are connectable to the dispersing device 1, in particular to the drive unit 3 of the dispersing device 1, it is provided that the dispersing tool 5 has a transponder 10, and the dispersing device has a transmitter-receiver unit 11 for reading out the transponder 10.

The invention claimed is:

1. A dispersing device (1) having a drive unit (3) which has a drive (2), and having a dispersing tool (5) which has a shaft tube (4) and at the free end (6) of which, averted from the drive (2), there is provided a dispersing rotor (7) which can be driven by means of a rotor shaft (8) which is connectable or connected to the drive (2) and which is arranged in the shaft tube (4), wherein, the dispersing tool (5) has a transponder (10) and the dispersing device (1) has a transmitter-receiver unit (11) for reading out the transponder (10), wherein, the transponder (10) is configured for wirelessly transmitting data to the transmitter-receiver unit (11).

2. The dispersing device (1) as claimed in claim 1, wherein, the transmitter-receiver unit (11) of the drive unit (3) is configured for identification of the dispersing tool (5) by means of data storable or stored on the transponder (10).

3. The dispersing device (1) as claimed in claim 1, wherein, the transponder (10) is arranged on an outer side (12) of the shaft tube (4).

4. The dispersing device (1) as claimed in claim 1, wherein, the dispersing tool (5) has a coupling (14) on a drive-side end (13), the drive unit (3) has a counterpart coupling (15), designed to fit with said coupling (14), for the transmission of torques from the drive (2) to the rotor shaft (8).

5. The dispersing device (1) as claimed in claim 1, wherein, the transponder (10) is arranged such that, in the use position of the dispersing tool (5), said transponder is arranged on the dispersing tool (5) outside a medium for processing by the dispersing device (1).

6. The dispersing device (1) as claimed in claim 1, wherein, the transponder (10) is writable with the transmitter-receiver unit (11) being configured for writing to the transponder (10).

7. The dispersing device (1) as claimed in claim 1, wherein, at least one sensor (18) is arranged on the dispersing tool (5).

8. The dispersing device (1) as claimed in claim 7, wherein, the at least one sensor (18) is, for the transmission of measurement data, connectable to the transponder (10) by means of a sensor connection (19).

9. The dispersing device (1) as claimed in claim 8, wherein, the sensor connection (19) is arranged in a groove (21) formed into the shaft tube (4).

10. The dispersing device (1) as claimed in claim 8, wherein, the sensor connector (19) includes a sensor cable (23) which runs through a sensor tube (22).

11. The dispersing device (1) as claimed in claim 7, wherein, the at least one sensor (18) is of liquid-tight form.

12. The dispersing device (1) as claimed in claim 7, wherein, the at least one sensor (18) of the dispersing tool (5) is arranged in an open depression (24) on the shaft tube (4).

13. The dispersing device (1) as claimed in claim 7, wherein, the at least one sensor (18) includes one or more from a group consisting of: temperature sensor, pH value sensor, and pressure sensor.

14. The dispersing device (1) as claimed in claim 7, wherein, the at least one sensor (18) is located on or adjacent to the free end (6) of the shaft tube (4).

15. The dispersing device (1) as claimed in claim 1, wherein, the drive unit (3) has a control and/or regulation unit (25) which is connected, for exchange of data, to the drive (2) and to the transmitter-receiver unit (11) and by means of which the drive (2) is controllable and/or regulable in a manner dependent on data transmitted from the transmitter-receiver unit (11) to the control and/or regulation unit (25).

16. The dispersing device (1) as claimed in claim 15, wherein, the dispersing device (1) is connectable to, in the use position, a temperature-control device for controlling a temperature of medium for dispersal, wherein, the temperature-control device is controllable or regulable, by means of the control unit (25) of the dispersing device (1), in a manner dependent on data transmitted from the transponder (10).

17. The dispersing device (1) as claimed in claim 1, wherein, the transponder (10) has a data memory (26) on which dispersing-tool-specific data are storable.

18. The dispersing device (1) as claimed in claim 1, wherein, the transmitter-receiving unit (11) is formed in or on the drive unit (3).

19. The dispersing device (1) as claimed in claim 1, wherein, the dispersing tool (5) is detachably couplable to the drive (2) and/or to the drive unit (3).

20. The dispersing device (1) as claimed in claim 1, wherein, in the use position of the dispersing tool (5), said transponder (10) is arranged within a dispersing tool receptacle (17) provided on the drive unit (3).

21. The dispersing device (1) as claimed in claim 1, wherein, the transponder (10) is formed as a RFID chip.

* * * * *